US006598530B1

(12) United States Patent
Schneider et al.

(10) Patent No.: US 6,598,530 B1
(45) Date of Patent: Jul. 29, 2003

(54) METHOD FOR FASTENING A FLEXIBLE PLATE

(75) Inventors: Georg Schneider, Würzburg (DE); Karl Robert Schäfer, Rimpar (DE); Roland Bernd Hofmann, Reichenberg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/926,653

(22) PCT Filed: May 25, 2000

(86) PCT No.: PCT/DE00/01702

§ 371 (c)(1),
(2), (4) Date: Nov. 29, 2001

(87) PCT Pub. No.: WO00/73067

PCT Pub. Date: Dec. 7, 2000

(30) Foreign Application Priority Data

May 29, 1999 (DE) ..... 199 24 787

(51) Int. Cl.[7] ..... B41F 27/12; B41L 29/14
(52) U.S. Cl. ..... 101/486; 101/415.1; 101/477
(58) Field of Search ..... 101/415.1, 477, 101/378, 389.1, 483, 485, 486, 409

(56) References Cited

U.S. PATENT DOCUMENTS

| | | | | | |
|---|---|---|---|---|---|
| 1,373,656 | A | * | 4/1921 | Drange | 101/415.1 |
| 3,149,565 | A | * | 9/1964 | Norlin | 101/415.1 |
| 4,347,788 | A | * | 9/1982 | Dufour et al. | 101/415.1 |
| 4,848,229 | A | * | 7/1989 | Grosshauser et al. | 101/382.1 |

FOREIGN PATENT DOCUMENTS

| | | |
|---|---|---|
| DE | 1 815 953 | 5/1970 |
| DE | 38 12 137 A1 | 1/1989 |
| DE | 43 35 140 C1 | 2/1995 |
| EP | 0 606 604 B1 | 12/1993 |
| GB | 2 206 534 A | 5/1988 |

* cited by examiner

*Primary Examiner*—Leslie J. Evanisko
(74) *Attorney, Agent, or Firm*—Jones, Tullar & Cooper, P.C.

(57) ABSTRACT

A plurality of flexible printing plates can be secured on a peripheral surface of a cylinder in a rotary printing press. The cylinder has several plate end clamping devices that can be actuated to release only selected ends of the flexible plates. This facilitates the sequential release or securement of the plates in a desired order.

4 Claims, 4 Drawing Sheets

METHOD FOR FASTENING A FLEXIBLE PLATE

FIELD OF THE INVENTION

The present invention is directed to a method for fastening a flexible plate on a cylinder of a rotary printing press. The flexible plate has angled suspension legs which are placed in a suspension slit on the cylinder surface. A cylinder groove underlies the slit. Inflatable air hoses and springs are used in conjunction with clamping devices that can be operated in a sequential manner.

DESCRIPTION OF THE PRIOR ART

A device for fixing a flexible printing plate on the forme cylinder of a rotary printing press having at least one cylinder groove extending in the axial direction is known from DE 43 35 140 C1.

A first, or leading suspension leg, which is beveled at an acute angle, is suspended at an edge of the first groove wall of the cylinder groove of the forme cylinder. A second, or trailing, suspension leg can be placed against the second groove wall, which second groove wall is extending approximately in the radial direction of the forme cylinder, of the cylinder groove. The cylinder groove contains a spindle which is pivotable around its axis. Two leaf springs, each of which is distributed over the width of the printing plate, are fastened on the spindle and can be brought into, or out of contact with the suspension legs in the course of pivoting the spindle.

DE 38 12 137 A1 describes a device for fastening a printing plate, wherein two pivotable fastening elements are seated in a hollow shaft.

EP 0 606 604 B1 discloses a device for the interlocked fastening of a printing plate. In this case, clamping strips are actuated by means of an air hose.

SUMMARY OF THE INVENTION

The object of the present invention is directed to providing a method for fastening a flexible plate on a cylinder of a rotary printing press.

In accordance with the present invention, this object is attained by providing the plate receiving cylinder with a plate end receiving suspension slit that overlies a cylinder groove. An inflatable air hose and springs located in the cylinder groove are utilized to shift plate end clamping devices between plate holding and plate release positions. The air hose can be inflated to two different pressure levels. The spring forces exerted by the various springs may also differ. This allows several plates to be released in a sequential manner.

The advantages to be obtained by the present invention consist, in particular, in that a rugged, simply constructed device is created, which can be produced cost-effectively. The device in accordance with the present invention can be displaced without the turning of a spindle in three positions. The device is particularly suited to clamping and releasing of several plates arranged at the circumference of a cylinder. A further advantage of the present invention lies in that in its axial extension it can consist of several short base bodies. It is possible, because of this, to remove the device laterally piece by piece from the cylinder groove, for example for maintenance purposes, without having to dismount the cylinder from the lateral frame. Automatic plate feeding and removal by the use of known devices is possible.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
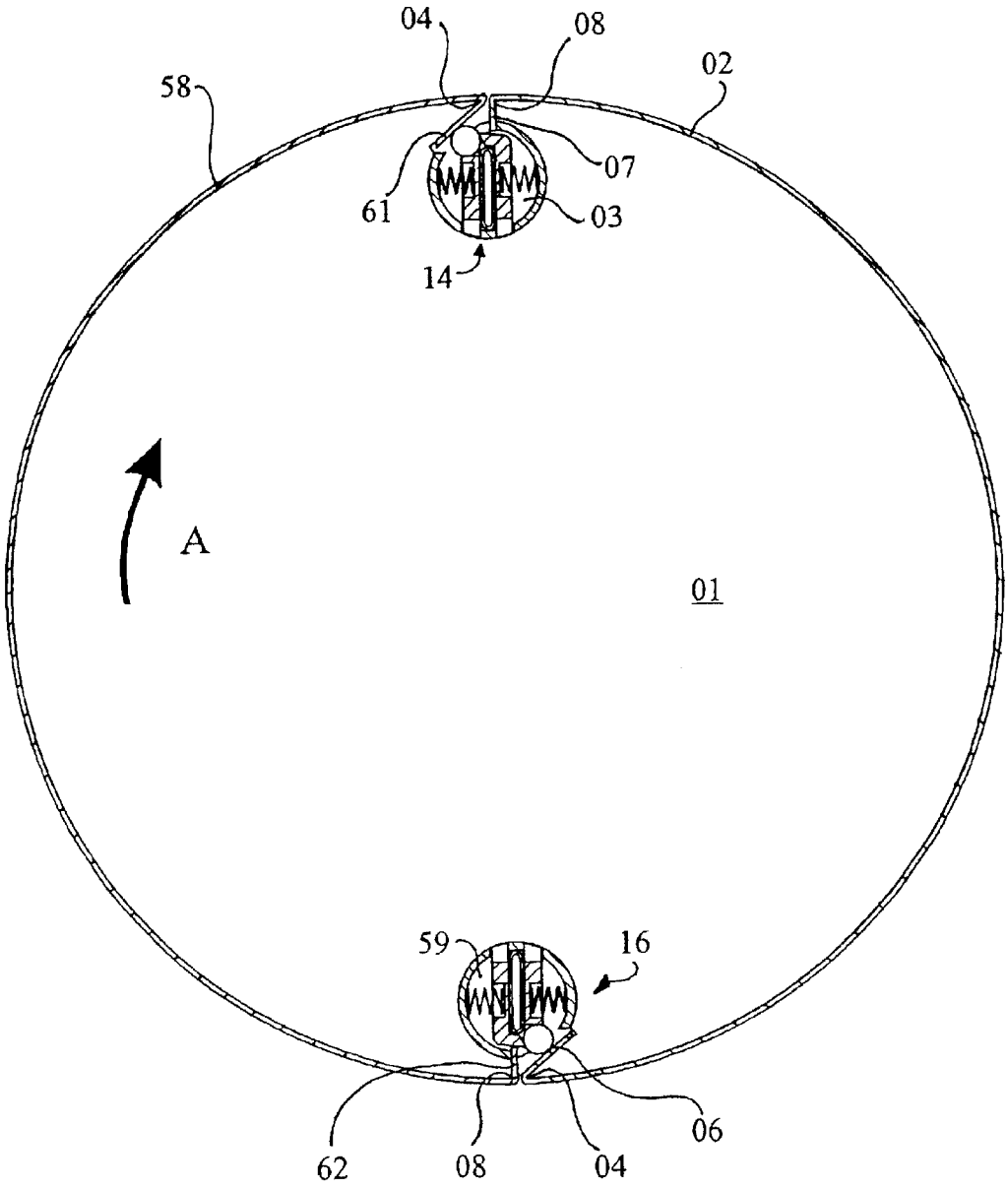
FIG. 1, a cylinder in cross section in the plate holding position with two plates clamped on the circumference by use of two devices in accordance with the present invention, FIG. 2, a representation of a device in accordance with FIG. 1 in an enlarged scale, FIG. 3, a representation analogous to FIG. 2, in a first release position, FIG. 4, a representation analogous to FIG. 2, in a second release position, and in FIG. 5, a section V—V in accordance with FIG. 2.

For receiving flexible plates 02, a cylinder 01, for example, a plate or a rubber blanket cylinder of a rotary printing press, is provided with two cylinder grooves 03, 59 each extending in the axial direction for receiving two flexible plates 02, 58 located on the circumference of cylinder 01, as seen in FIG. 1. At a front edge 04 pointing in the production direction A of the cylinder 01, each cylinder groove 03, 59 receives a front, or "leading", beveled suspension leg 06, 61 of the plate 02, 58. Each plate 02, 58 furthermore has a rear, or "trailing" beveled suspension leg 07, 62, which is suspended from a second, rear edge 08 of the same cylinder groove 03, 59.

An acute opening angle $\alpha$, for example up to 45°, is formed between the peripheral surface 11 of the cylinder 01 and a first cylinder wall 12 of the cylinder groove 03, 59. A second groove wall 13, extending approximately in the radial direction of the cylinder 01, has an obtuse opening angle$\beta$of approximately 95° with respect to the cylinder's peripheral surface 11. Both edges 04, 08, which are also vertex points of the opening angles $\alpha$, $\beta$ are separated by a fastening slit 09.

The fastening slit 09 is embodied, in its inner width b, in such a way that at least two suspension legs 06, 62, or 07, 61, which all project into the cylinder groove 03, 59, can be placed therein next to each other, as seen most clearly in FIG. 1.

The plates 02, 58 can be embodied in the form of flexible printing plates, for example. Also, several plates can be placed side by side. The plates can also be provided as flexible support plates with rubber blankets arranged on them.

The cylinder groove 03 can be approximately circular in cross section. It is connected with the cylinder peripheral surface 11 through the fastening slit 09.

Each cylinder groove 03, 59 receives a clamping device 14, 16, both of which are embodied the same and both of which are arranged in a base body 19. Each base body 19 has the form of a longitudinally cut tube so as to be channel-shaped, which tube extends in an axis-parallel direction in the cylinder groove 03, 59 and points with its opening 31 generally in the direction toward the first groove wall 12, or in the direction of the fastening slit 09.

The channel-shaped base body 19 can be embodied to be C-shaped, U-shaped, round, oval or polygonal in cross section. The cross section of the cylinder groove 03 is matched to the cross section of the base body 19 which is received in the cylinder groove 03, as seen each of FIGS. 1–4.

Figure 5:
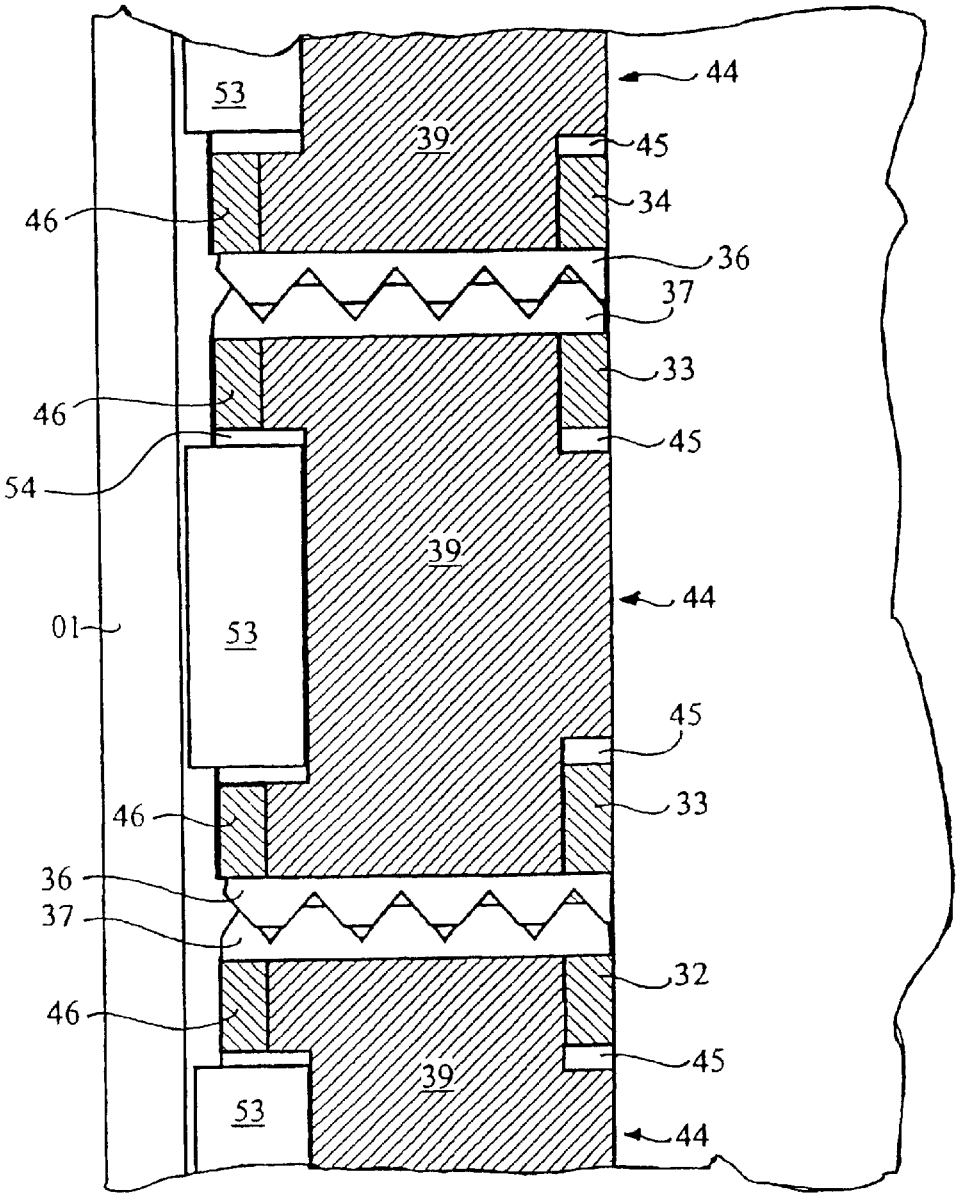

In accordance with an embodiment which is depicted in FIG. 5, the base body 19 is divided in the axial-parallel direction into several short base bodies 32, 33, 34. Each short base body 32, 33, 34 is releasably connected with its adjoining short base body 32, 33, 34, for example by a coupling. Such a coupling can act interlockingly, for example, and can be implemented by sets of teeth 36, 37 at both ends of each of the short base bodies 32, 33, 34.

A free end of the first and last short base body in the cylinder groove 03, 59 is connected, fixed against relative rotation, with an end coupling element. With its portions covering the cylinder groove 03, 59, the end coupling element is fastened on the flanks of the cylinder 01, for example screwed to it.

Because of the employment of several short base bodies 32 to 34, the device can be taken out of the cylinder groove 03, 59, for example for maintenance purposes, without it being necessary to remove the cylinder 01 from the lateral frame.

Figure 3:
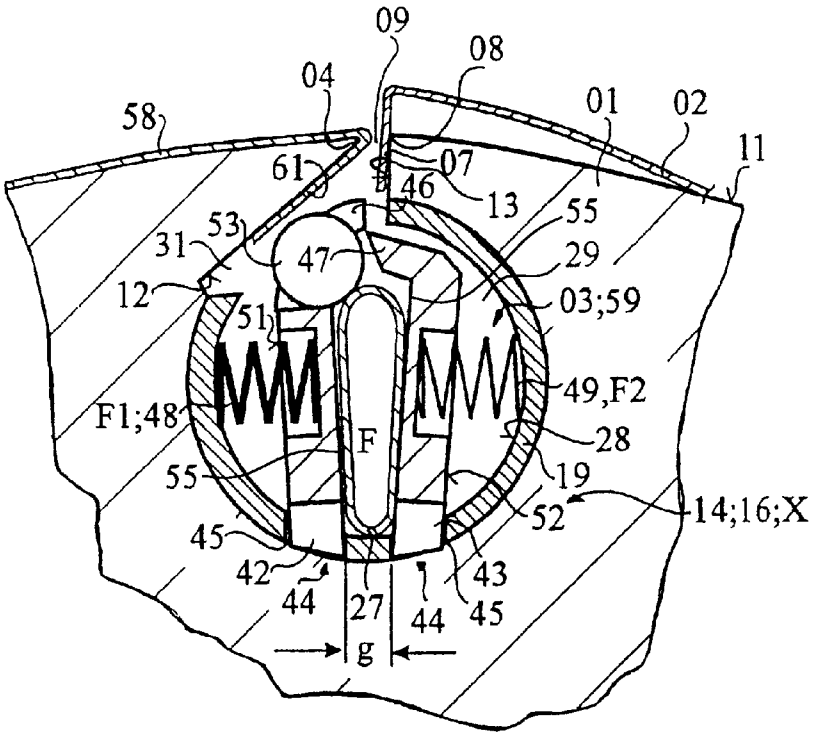

Movable gripping and/or clamping elements are arranged in each base body 19, or short base bodies 32 to 34, which movable gripping and/or clamping elements consist of two strips 39, 41, which extend parallel with each other. First, or lower ends 42, 43 of strips 39, 41 are pivotably seated apart from each other at a clear distance g, of, for example, one-sixth or one-eighth of the diameter d of the cylinder groove 03, 59, in abutments 44 as seen in FIG. 3. The abutments 44 can consist of slits 45 arranged in the base body 19, or in the respective short base bodies 32 to 34, which slits 45 are engaged by portions of the lower ends 42, 43 of the strips 39, 41, as seen most clearly in FIGS. 2, 3 and 4.

Figure 2:
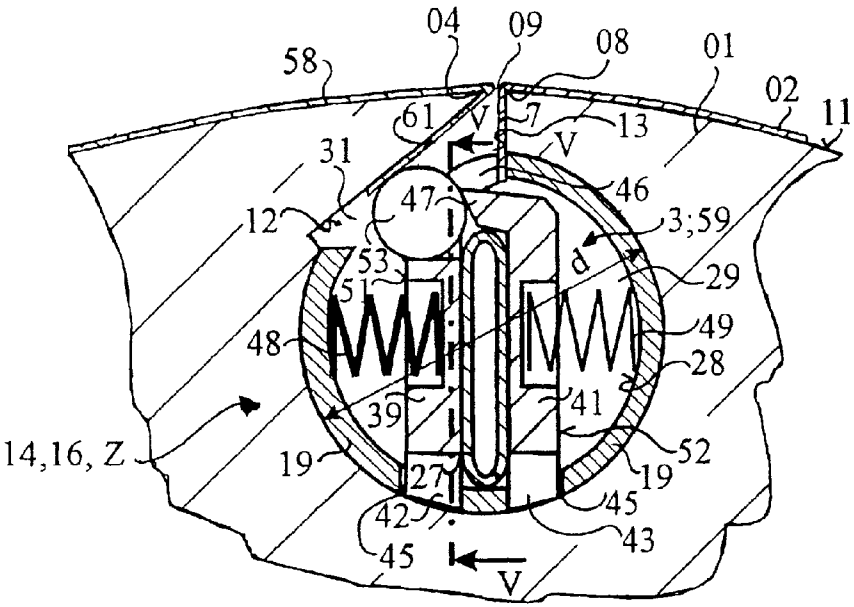

Second, or upper ends 46, 47, defined as force-engagement ends of the strips 39, 41, are situated close to the suspension legs and are bent off approximately at right angles, as seen in FIGS. 2 and 3. These upper ends 46, 47 extend from the interior 29 of the base body 19, or the short base bodies 32 to 34 and are in direct or indirect operative connection with the respectively opposite suspension legs 06, 62, or 07, 61 of the plates 02, 58. They press these plate ends against the first, or the second groove wall 12, 13 by using the force of respectively at least one spring 48, 49, for example a pressure spring. The pressure springs 48, 49 are respectively arranged between the inner wall 28 of the base body 19 and the exteriors 51, 52 of the strips 39, 41.

An indirect operative connection means that at least one roller body, for example a gripping roller 53, for each short base body 32 to 34 is arranged between the upper end 47, beveled in the direction toward the first groove wall 12, of the strip 41 and the suspension leg or legs 06, or 61, resting against the first groove wall 12.

The gripping roller 53 for each short base body 32 to 34 lies in a cutout 54 located at the upper end 46, which is near the suspension leg, of the strip 39 as seen in FIG. 5. Beveled or angled arms of the upper end 46 of the strip 39 remain on both sides of the cutout 54 and press against the second groove wall 13, or against the suspension leg 07, 62 inserted between the second groove wall 13 and the upper end 46 of the strip 39, as seen in FIGS. 1 and 2.

An air hose 27 is located between the inner walls 55 of the strips 39, 41, which air hose 27 extends in one piece over the entire length of the cylinder groove 03. The air hose 27 extends in this way through the base body 19, or the short base bodies 32 to 34. At one of its ends, the air hose 27 is provided with a valve and is charged with compressed air, when needed, via a line, not specifically represented, to the cylinder journal connected with it and by a known rotary inlet.

A force of pressure F1 exerted by the spring 48 is greater than a force of pressure F2 exerted by the spring 49.

The previously named elements 39, 41, 48, 49, 53, located in the interior 29 of the base body 19 are called gripping and/or clamping elements. This also applies with respect to the short base bodies 32 to 34.

A method for releasing only a first plate 02, which is one of two flexible plates 02, 58 fastened on the circumference of the cylinder, proceeds as follows: the air hose 27 of the first clamping device 14, shown in FIG. 1, is charged with compressed air at a pressure of approximately four bar. By means of this, the strips 39, 41 are pivoted into a first release position X against the force F1, F2 of the springs 48, 49, as seen in FIG. 3. All clampings are released. The rear suspension leg 07 of the plate 02 snaps out of the fastening slit 09 because of its inherent tension. The front suspension leg 61 of the second plate 58 is held in place at the front edge 04 of the cylinder groove 03. The air pressure in the hose 27 of the clamping device 14 is then removed.

Figure 4:
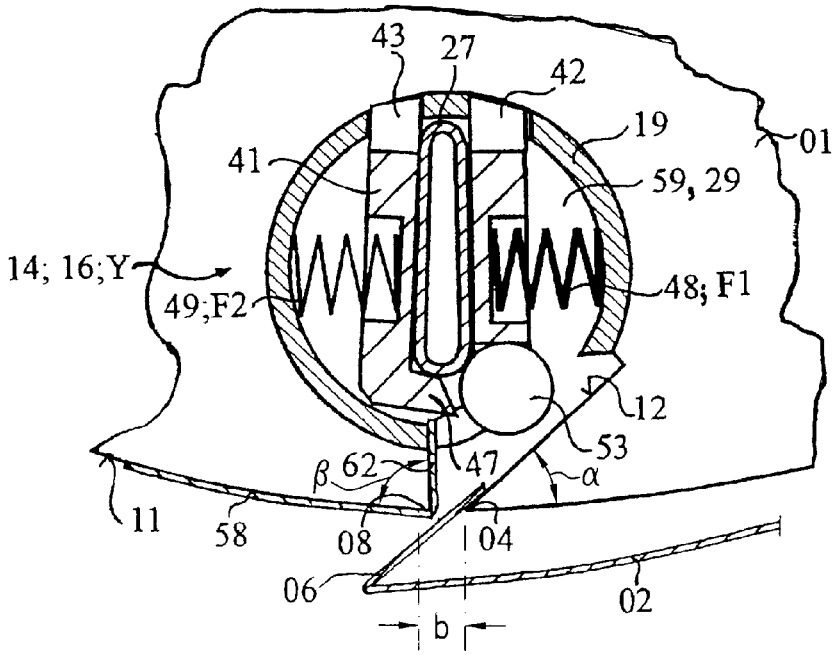

Now, the air hose 27 of the second clamping device 16 is charged with compressed air at approximately two bar. Because of this, as depicted in FIG. 4, only the strip 41 is pivoted against the force F2 of the weaker spring 49, so that only the front suspension leg 06 of the plate 02 is released into a second release position Y. The rear suspension leg 62 of the second plate 58 remains clamped, because the spring 48 with the greater force of pressure F1 does not yield under the second, lower pressure provided to the air hose 27.

Clamping of plates 02 or 58 takes place in the reverse sequence.

It is also possible to fasten three or more plates having the corresponding number of clamping devices on the cylinder 01.

While a preferred embodiment of a method and devices for fastening a flexible plate, in accordance with the present invention, have been set forth fully and completely hereinabove, it will be apparent to one of skill in the art that various changes in, for example, the overall size of the cylinder, the drive for the cylinder and the like could be made without departing from the true spirit and scope of the present invention which is accordingly to be limited only by the following claims.

What is claimed is:

1. A method for clamping and releasing flexible plates positioned on a cylinder including:

providing first and second cylinder grooves in the cylinder with each said cylinder groove having a front edge and a rear edge;

providing first and second suspension slits on a peripheral surface of the cylinder and locating said first and second suspension slits radially outwardly from said first and second cylinder grooves;

using said cylinder groove front edges to define said suspension slits;

providing a front plate suspension leg clamping device and a rear plate suspension leg clamping device in each of said first and second cylinder grooves;

providing a first actuating device in said first cylinder groove and a second actuating device in said second cylinder groove with each of said first and second actuating devices being selectively operable to exert first and second different levels of force against said front and rear plate suspension leg clamping devices;

operating said first and second actuating devices during a first unclamping sequence for releasing only a first one of the flexible plates positioned on the cylinder including exerting said first level of force using said first actuating device for releasing a rear suspension leg of the first plate by opening said rear plate suspension leg clamping device in said first cylinder groove;

retaining a front suspension leg of a second plate positioned in said first cylinder groove during release of said rear suspension leg of the first plate during said operation of said first actuating device at said first level of force;

releasing a front suspension leg of the first plate by operating said second actuating device and exerting said second level of force and opening said front plate suspension leg clamping device in said second cylinder groove; and retaining a rear suspension leg of the second plate in said second cylinder groove.

2. The method of claim 1 further including clamping the first plate to the cylinder by reversing said unclamping sequence.

3. The method of claim 1 further including providing said first and second actuating devices as air hoses which can be charged with compressed air.

4. The method of claim 3 further including charging each said air hose at first and second different pressures.

* * * * *